US005193324A

United States Patent [19]

Fellows

[11] Patent Number: 5,193,324

[45] Date of Patent: Mar. 16, 1993

[54] CONCRETE BEAM REINFORCEMENT SYSTEM

[76] Inventor: Richard R. Fellows, 1001 E. Mackinac Ave., Oak Creek, Wis. 53154

[21] Appl. No.: 850,476

[22] Filed: Mar. 12, 1992

[51] Int. Cl.[5] ..... E04B 1/00

[52] U.S. Cl. ..... 52/743; 52/251; 52/293.2; 405/262; 405/284

[58] Field of Search ..... 52/743, 744, 741, 292, 52/295, 293, 296, 169.5, 251; 405/262, 284, 285, 286, 258

[56] References Cited

U.S. PATENT DOCUMENTS 1,343,926 6/1920 Madsen ..... 52/293 X
4,452,028 6/1984 Norton et al. .
4,685,268 8/1987 Roy .
4,706,428 11/1987 McCoy et al. .
4,916,874 4/1990 McCoy et al. .

FOREIGN PATENT DOCUMENTS 78739 11/1947 Norway ..... 52/251

*Primary Examiner*—David A. Scherbel
*Assistant Examiner*—Creighton Smith
*Attorney, Agent, or Firm*—Henderson & Sturm

[57] ABSTRACT

A method of reinforcing concrete block foundation walls (100) by fabricating a reinforced concrete beam (10) which includes a plurality of concrete columns formed on the interior of the foundation walls (100) and surrounding vertical steel rerods (20) which extend from the foundation slab (102) through openings in the foundation walls (100) and into the cantilevered finished concrete beam (10).

9 Claims, 2 Drawing Sheets

CONCRETE BEAM REINFORCEMENT SYSTEM

TECHNICAL FIELD

The present invention relates to the field of static structured repair and reinforcement in general, and in particular to a method of reinforcing concrete block walls in the foundation of a home by fabricating a concrete beam that becomes an integral part of the foundation.

BACKGROUND ART

As can be seen by reference to the following U.S. Pat. Nos. 4,916,874; 4,452,028; 4,706,428; and 4,685,268; the prior art is replete with myriad and diverse reinforcement systems for concrete block walls.

While all of the aforementioned prior art methods are more than adequate for the basic purpose and function for which they have been specifically designed, these patented systems do not offer either the strength, stability, or ease of installation that is provided by the system that forms the basis of the present invention.

The need for reinforcing concrete block walls is prevalent in areas where soil types cause exterior pressure against the wall. The soil pressure causes the walls to crack and move inward primarily at the frost line. The bottom row of blocks are held in place by the concrete basement floor and the top row of blocks are held by friction and/or anchor bolts to the structure. The corners are stable as a result of the adjoining walls which support them at 90 degree angles. The strength of the wall is dependent on the weight of the structure it supports and therefore single story homes have frequent failures. The pressure on the wall is greatest at the base under dry conditions but increases dramatically in the top 3 feet when there are wet conditions. This pressure is greatly increased when there is a deep frost and the natural expansion of water freezing takes place.

DISCLOSURE OF THE INVENTION

Briefly stated, the concrete block reinforcement system that forms the basis of the present invention involves the excavation and external penetration of a concrete block wall at a point below the final grade, followed by the insertion of elongated contoured vertical steel rerods which extend from the bottom of the foundation and project outwardly through the wall penetrations in the form of a hook.

At this point a plurality of horizontal steel rerods are positioned relative to the hooked portion of the vertical steel rerods within a concrete form and then concrete is injected first through the openings in the wall and then into the concrete form which surrounds the rerods on the outside wall surface.

As will be explained in greater detail further on in the specification, this system produces a reinforced concrete beam footing which not only projects a substantial distance out from the foundation walls at the point of greatest stress; but also extends a substantial vertical distance within the walls in the form of closely spaced columns; wherein, the columns become integral reinforced portions of the original foundation walls.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
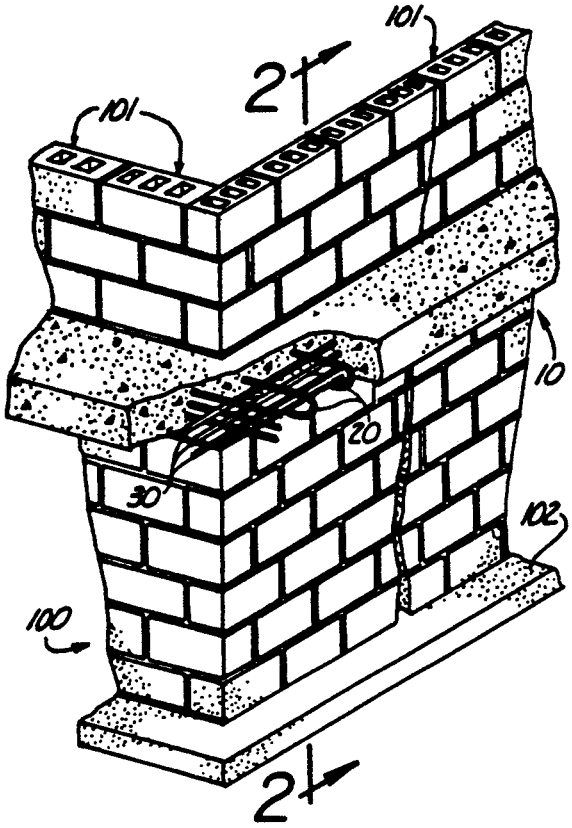
FIG. 1 is a cut-away perspective view of a foundation wall reinforced in accordance with the teachings of this invention.
Figure 2:
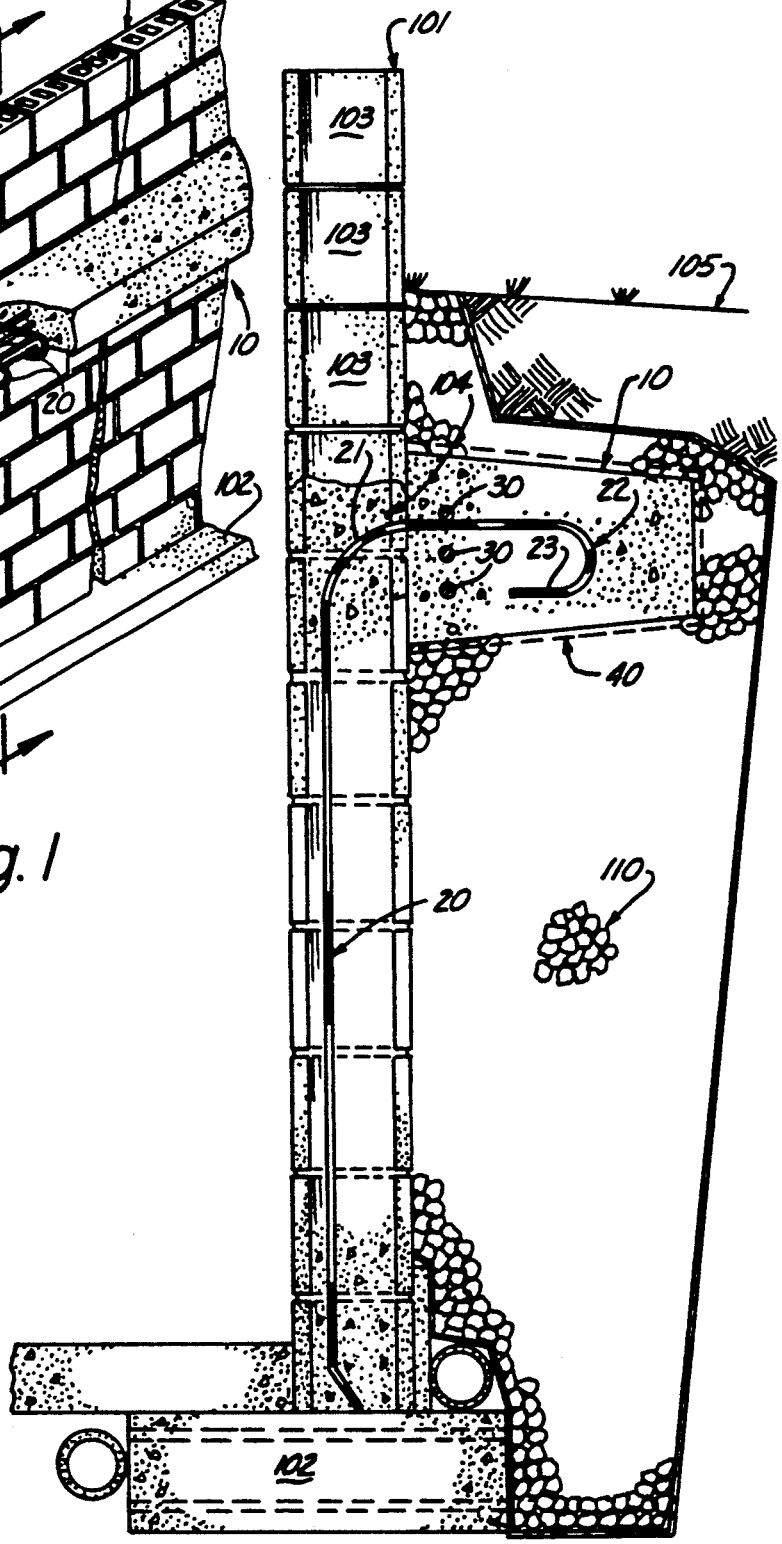
FIG. 2 is a cross-sectional view of the finished construction.

As can be seen by reference to the drawings, and in particular to FIGS. 1 and 2 the method of reinforcement that forms the basis of the present invention is specifically designed to reinforce existing foundation walls (100) constructed with conventional concrete blocks (101) having hollow passageways (103) formed therein; wherein the foundation walls (100) rest upon a concrete slab (102).

As mentioned previously, the foundation walls (100) experience the greatest amount of stress in the area concentrated around the frost line which for practical purposes is the first three feet below the final grade designated as (105) in FIG. 2. Therefore the first step that is employed in the method of this invention is to excavate a trench around the foundation walls to a selected depth below the final grade.

Once the below ground portions of the walls (100) have been exposed a plurality of spaced openings (104) are created in the exterior faces of a selected run of blocks (101) to provide access from the outside of the foundation into the interior passageways (103) within the foundation walls (100).

At this juncture it should be noted that under ideal conditions a series of smooth vertical passageways should exist within the interior of the foundation walls (100) wherein the vertical passageways will extend from the concrete slab (102) to the top of the foundation walls (100). However in many actual instances there will be obstructions present in these vertical passageways which will have to be cleared from the point of penetration of the external surfaces of the walls (100) down to the foundation slab (102).

Therefore, presuming that the ideal conditions exist, the next step in the method of this invention is the insertion of elongated generally straight vertical steel rerods (20) through the spaced openings (104) in the foundation walls (100); wherein, the upper portion of the steel rerods (20) are curved about an arc of approximately 90° as at (21) to pass in a generally horizontal fashion outwardly through the openings (104); and, wherein the outboard ends (22) of the vertical rerods (20) are curved downwardly into a downwardly depending hook (23).

Figure 3:
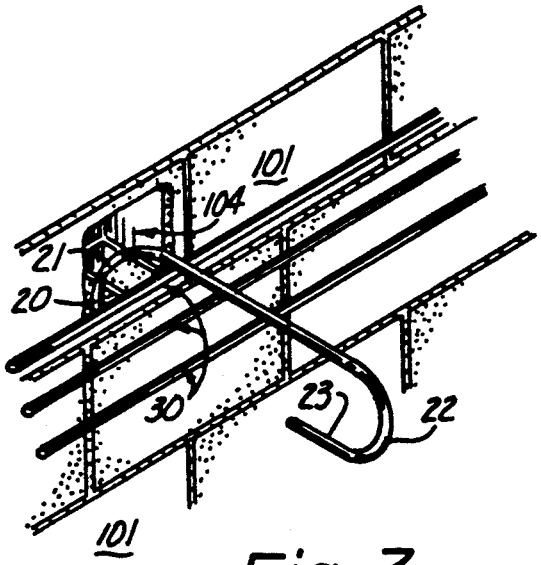
FIG. 3 is a perspective view of the positioning of the vertical and horizontal rerods prior to the pouring of the concrete; and, FIG. 4 is a cross-sectional view of an alternate method of arriving at the finished construction.

As shown in FIGS. 2 and 3, the next step in the reinforcement method is the placement of a plurality of elongated horizontal steel rerods (30) both above and below the upper portion of the vertical steel rerods (20) in a well recognized manner, such as by the use of wire hangers or the like (not shown).

At this point a concrete form (40) indicated by the dashed lines in FIG. 2 is placed in a surrounding relationship relative to the exposed portions of the vertical (20) and horizontal (30) rerods; and, in an abutting relationship with the external surfaces of the foundation walls (100), both above, and below the spaced openings (104).

The final step in the reinforcement method of this invention is the introduction of concrete both through the openings (104) and into the vertical passageways (103) surrounding the generally straight lower portion of the vertical rerods (20); as well as the concrete form (40) which will define the contour of the finished reinforced concrete beam footing (10).

In this manner the vertical rerods (20) will be encased in individual spaced vertical columns of cured concrete within the interior of the foundation walls (100): wherein, the finished concrete beam footing (10) will be formed integrally with the reinforced vertical columns, and reinforced by both the hooked upper portions (23) of the vertical rerods (20) as well as the horizontal rerods (30) which are operatively connected thereto.

In the preferred embodiment of the invention depicted in the drawings the finished reinforced concrete beam (10) will have a tapered configuration and project outwardly from the exterior surface of the wall approximately sixteen inches; however, it should be appreciated that both the shape and exact dimensions of the finished construction can be varied to suit different soil and climatic conditions, in keeping with the teachings of this invention.

Figure 4:
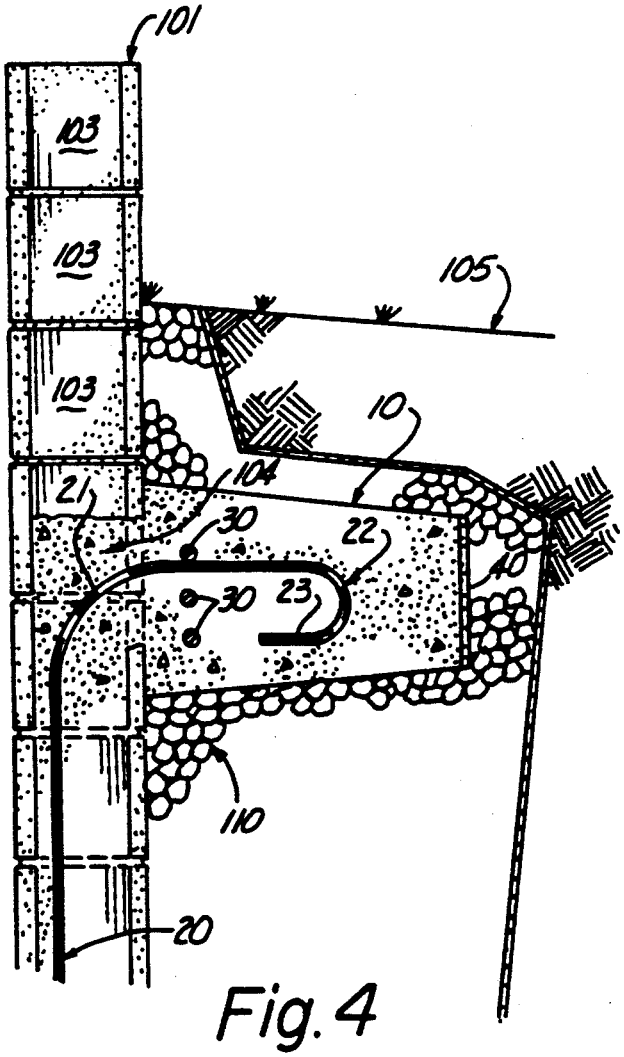

In the alternate version of the preferred embodiment depicted in FIG. 4, a full concrete form (40) is dispensed with, and backfill stones (110) are used in lieu of the bottom of the concrete form (40). Furthermore only the vertical walls (40') of the concrete form (40) depicted in FIG. 2 are employed in this particular version; such that the backfill stones (110) and the vertical walls (40') cooperate with the exterior surface of the foundation walls (100) to define the final contours of the finished concrete beam (10).

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A method of reinforcing existing conventional concrete block construction foundation walls resting on a concrete slab foundation; wherein, the method comprises the following steps a) creating spaced openings in the exterior surface of the foundation walls at a selected depth below the final grade b) inserting through each of the openings an elongated vertical steel rerod having: a generally straight lower portion which extends through hollow vertical passageways in the interior of the foundation walls, wherein the bottom of the vertical rerods rests on the foundation slab; and, also having a bent upper portion which projects outwardly from the respective openings in a generally horizontal fashion c) operatively attaching a plurality of horizontal rerods to the generally horizontal portion of each of the vertical rerods d) at least partially surrounding the horizontal rerods and the upper portion of the vertical rerods in a concrete form disposed in at least one plane relative to the exterior of the foundation walls e) pouring concrete through said openings to surround the lower portions of the vertical rerods in a column of concrete; and f) continuing to pour concrete into said concrete forms to surround the horizontal rerods and the upper portions of the vertical rerods in a finished concrete reinforced beam.

2. The method as in claim 1; wherein, the outer end of the upper portion of each vertical rerod is formed into a hook.

3. The construction as in claim 1; wherein, said at least one plane of the concrete form is oriented in the vertical direction.

4. The construction as in claim 1; wherein, the concrete form is disposed in two planes relative to the exterior of the foundation walls.

5. The construction as in claim 4; wherein, the concrete form is disposed in both the horizontal and vertical plane relative to the exterior of the foundation walls.

6. An integrally formed reinforced concrete beam construction for concrete blocks resting on a concrete foundation slab and having a plurality of spaced openings formed therein; wherein, the beam construction comprises:

a contoured reinforced concrete beam projecting outwardly in an abutting relationship with the exterior surface of the foundation walls; and, a plurality of vertical steel rerods encased in horizontally spaced, vertical concrete columns that are disposed in a spaced relationship within the interior of the foundation walls; wherein, the horizontally spaced, vertical concrete columns are formed integrally with, and depend downwardly from said reinforced concrete beam.

7. The construction as in claim 6; wherein, each of said vertical steel rerods have an upper bent portion which projects inside of the reinforced concrete beam after passing through one of the spaced openings in the foundation wall.

8. The construction as in claim 7; wherein, the upper bent portion of the vertical steel rerods are formed into a downwardly depending hook.

9. The construction as in claim 8; further comprising a plurality of elongated horizontal rerods operatively connected to the upper portions of the vertical rerods.

* * * * *